US008596480B2

(12) United States Patent
Arjomand

(10) Patent No.: US 8,596,480 B2
(45) Date of Patent: Dec. 3, 2013

(54) MODULAR BEVERAGE CONTAINER SYSTEM

(76) Inventor: Hamid Arjomand, Tigard, OR (US)

( * ) Notice: Subject to any disclaimer, the term of this patent is extended or adjusted under 35 U.S.C. 154(b) by 0 days.

(21) Appl. No.: 13/272,140

(22) Filed: Oct. 12, 2011

(65) Prior Publication Data

US 2012/0091131 A1 Apr. 19, 2012

Related U.S. Application Data

(60) Provisional application No. 61/392,631, filed on Oct. 13, 2010.

(51) Int. Cl.
*B65D 6/00* (2006.01)
*B65D 39/00* (2006.01)
*B65D 41/04* (2006.01)

(52) U.S. Cl.
USPC ..... 220/4.01; 220/4.07; 220/4.27; 206/218; 215/228; 215/329

(58) Field of Classification Search
USPC ..... 206/223, 216, 217, 218; 220/4.01, 4.04, 220/4.07, 4.08, 4.28, 529, 212, 23.83, 220/23.86, 4.26, 4.27, 501; 215/228, 215/DIG. 7, 6, 329; D07/507
See application file for complete search history.

(56) References Cited

U.S. PATENT DOCUMENTS 640,860 A * 1/1900 Baum ..... 215/377
4,027,779 A 6/1977 De Long
4,444,324 A * 4/1984 Grenell ..... 215/6
5,499,738 A 3/1996 Burleigh
5,618,004 A 4/1997 Klearman et al.
D410,364 S * 6/1999 Ramirez et al. ..... D7/507
6,145,685 A * 11/2000 Dick ..... 220/23.88
6,409,038 B1 6/2002 Karp
6,662,959 B1 12/2003 Westerhold
6,905,038 B2 * 6/2005 Lopez ..... 215/228
7,467,726 B1 * 12/2008 Izraelev ..... 215/396
7,770,748 B2 * 8/2010 Elliott ..... 220/212

(Continued)

FOREIGN PATENT DOCUMENTS

KR 200353874 6/2004
WO 2012051356 A2 4/2012

OTHER PUBLICATIONS www.alexbottle.com—water bottle (printed Oct. 12, 2011 from http://web.archive.org/web/20100509212502/http://www.alexbottle.com/co-brand.html.

*Primary Examiner* — Steven A. Reynolds
*Assistant Examiner* — Javier A Pagan
(74) *Attorney, Agent, or Firm* — Patent Law Offices of Michael E. Woods; Michael E. Woods

(57) ABSTRACT

A multimodal container includes a first shell having a base and a first wall coupled to the base, the first wall defining a first cavity and a first cavity opening general opposite of the base; a second shell having a second wall defining a second cavity and a second cavity opening; and a coupler selectively engaging the shells proximate the openings to join the second shell to the first shell alternately in one of a bottle mode and a cup mode, the bottle mode including the second shell extending away from the first shell with the coupler disposed therebetween forming a bottle and the cup mode including the second shell nested within the first cavity forming a double-walled cup.

4 Claims, 7 Drawing Sheets

(56) References Cited

U.S. PATENT DOCUMENTS

| | | | | |
|---|---|---|---|---|
| 8,146,758 | B1 * | 4/2012 | Peres | 215/6 |
| 2004/0262252 | A1 * | 12/2004 | Hammer | 215/228 |
| 2005/0061764 | A1 | 3/2005 | Tamashiro | |
| 2006/0201900 | A1 * | 9/2006 | de Francesco | 215/6 |
| 2007/0138176 | A1 * | 6/2007 | Gawlick | 220/4.26 |
| 2009/0071925 | A1 * | 3/2009 | Lackey | 215/10 |
| 2009/0178940 | A1 * | 7/2009 | Said | 206/221 |
| 2009/0188884 | A1 * | 7/2009 | Nelson et al. | 215/6 |
| 2010/0065557 | A1 * | 3/2010 | Gersovitz | 220/4.06 |
| 2010/0200438 | A1 * | 8/2010 | Davies | 206/223 |
| 2010/0200582 | A1 * | 8/2010 | Hammerle et al. | 220/4.27 |
| 2010/0288759 | A1 * | 11/2010 | Hotell | 220/23.83 |

* cited by examiner

MODULAR BEVERAGE CONTAINER SYSTEM

CROSS REFERENCE TO RELATED APPLICATIONS

This application claims the benefit of U.S. Provisional Application 61/392,631 filed on Oct. 13, 2010, the contents of which are hereby expressly incorporated in its entirety by reference thereto.

BACKGROUND OF THE INVENTION

This invention relates generally to containers and more particularly but not exclusively to bottles used to carry water or other beverages, preferably during active or mobile activities such as hiking or camping.

Water is the most important necessity for survival in the outdoors and ready access to it is essential to prevent dehydration. It is therefore important for hikers and campers to always have at least one, and preferably several, containers of water in their supplies. Stainless Steel or Aluminum bottles are popular as they are durable, chemical-free, and eco-friendly. However, such bottles are also bulky and can be difficult to clean on the inside.

For campers and hikers, particularly for extended duration camping and hiking, it is often desirable to have several different types of containers and devices for various uses and functions encountered during the activity. Because the camper/hiker typically must carry the gear as they move about, it is common for equipment used during these activities to be light-weight, portable, durable, and when possible, serve multiple uses.

Water and other fluids are consumed from a variety of different containers, a water bottle are represents but one mode. In some cases, it is desirable to consume beverages from a cup. It is sometimes the case that the fluid is particularly hot or cold and it would be advantageous to have use of a double-walled temperature insulating cup when consuming beverages such as these. Unfortunately it is often a luxury for the camper/hiker to add such a piece of equipment to their gear and many do not opt to add such a specialized apparatus when considering what equipment is appropriate to pack and carry around.

What is needed is a solution to a problem of carrying multiple different container types, particularly for campers and hikers and others having reduced capacity for carrying equipment.

BRIEF SUMMARY OF THE INVENTION

Disclosed is a solution to a problem of carrying multiple different container types, specifically an apparatus and method for a multimodal (e.g., reconfigurable) container. The present invention includes embodiments directed towards construction, use, and operation of configurable containers. The following description includes a discussion of some of the technical features and benefits, however the full scope of the present invention is presented throughout the entire specification, including the drawing and claims, and nothing in this summary portion of the application is taken as limiting the scope of the invention.

A multimodal container includes a first shell having a base and a first wall coupled to the base, the first wall defining a first cavity and a first cavity opening general opposite of the base; a second shell having a second wall defining a second cavity and a second cavity opening; and a coupler selectively engaging the shells proximate the openings to join the second shell to the first shell alternately in one of a bottle mode and a cup mode, the bottle mode including the second shell extending away from the first shell with the coupler disposed therebetween forming a bottle and the cup mode including the second shell nested within the first cavity forming a double-walled cup.

A method for configuring a multimodal container includes a) attaching a coupler to a first shell, the first shell having a base and a first wall coupled to the base, the first wall defining a first cavity and a first cavity opening general opposite of the base; b) orienting a second shell in one of two orientations with respect to the first shell, the second shell having a second wall defining a second cavity and a second cavity opening wherein the two orientations both include the second opening proximate the first opening with a bottle-making orientation having the second shell extending away from the first opening and the base and with a cup-making orientation having the second shell extending away from the first opening and towards the base with the second shell disposed within the first cavity; and thereafter c) attaching the coupler to the second opening with the second shell in either orientation.

Features/benefits include a metal bottle (Stainless Steel, Aluminum, Titanium, and the like) having two detachable portions that are combinable to either form a large-capacity, single-walled container or reconfigured into a smaller, double-walled, container. In its large or extended 'bottle' configuration, the container functions as a regular-sized bottle for carrying and drinking water or other fluids. In its small or compacted 'cup' configuration, it functions as an insulated cup for hot or cold beverages. Also, in its compacted configuration, the container takes up less space when stowed away in a backpack or other gear-carrying bag. In both configurations, when not used for carrying water or other beverages, the interior can serve as additional storage space, such as filters or other water purifying treatments (e.g., iodine tablets or UV light sources). Alternately, the interior space can be used to store food or beverage packets, such as dehydrated meals or soups or beverage mixes. In addition, each of the two detachable portions of the container can be used independently for other functions. The lower or 'outer' portion can serve as a separate cup or cooking container. The upper or 'inner' portion can be used as a funnel or water filter holder. Finally, the detachable construction of the container makes it easier to wash and clean its interior walls.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a solution to a problem of carrying multiple different container types. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
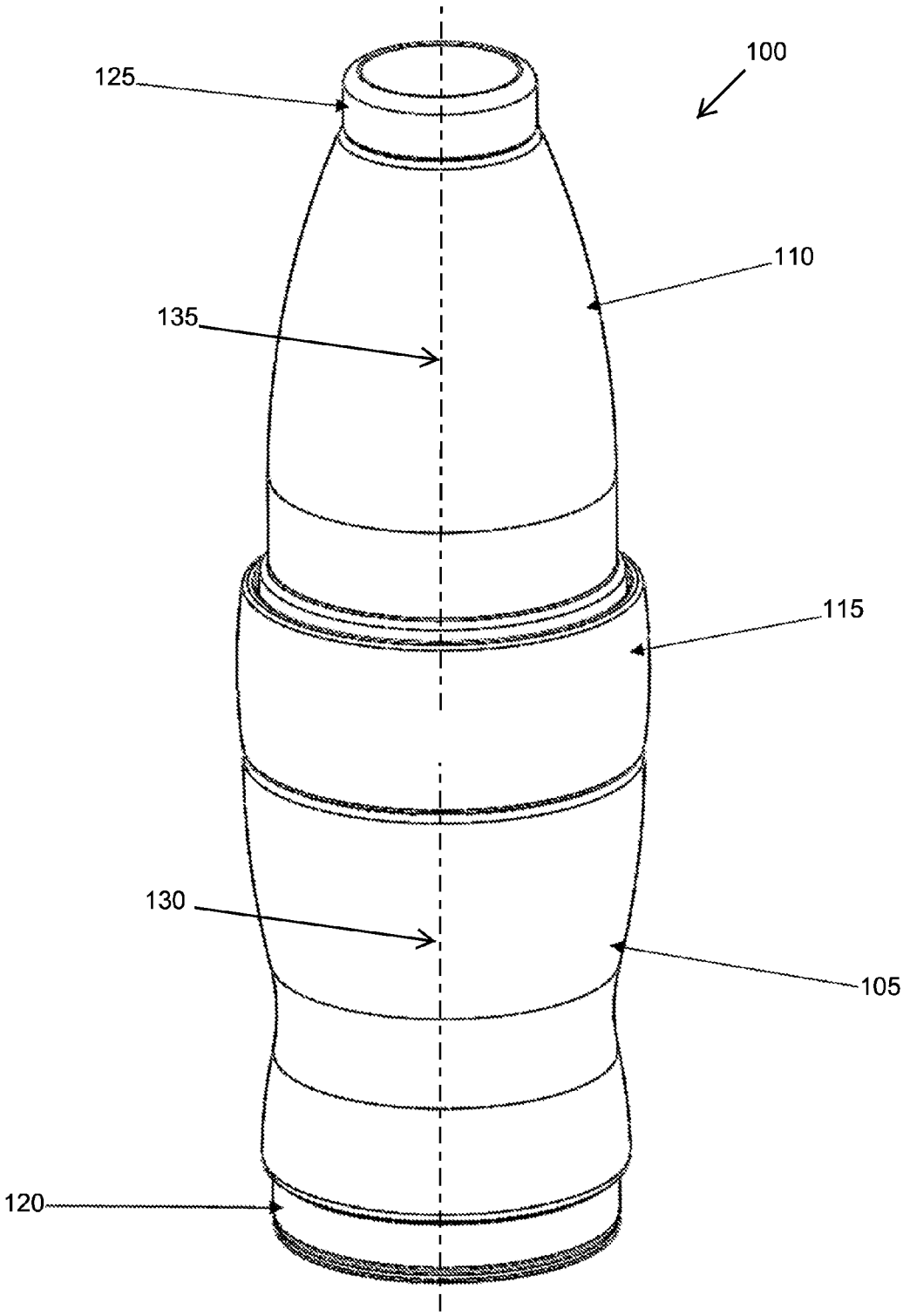
FIG. 1 illustrates a multimodal container in a bottle configuration.
Figure 2:
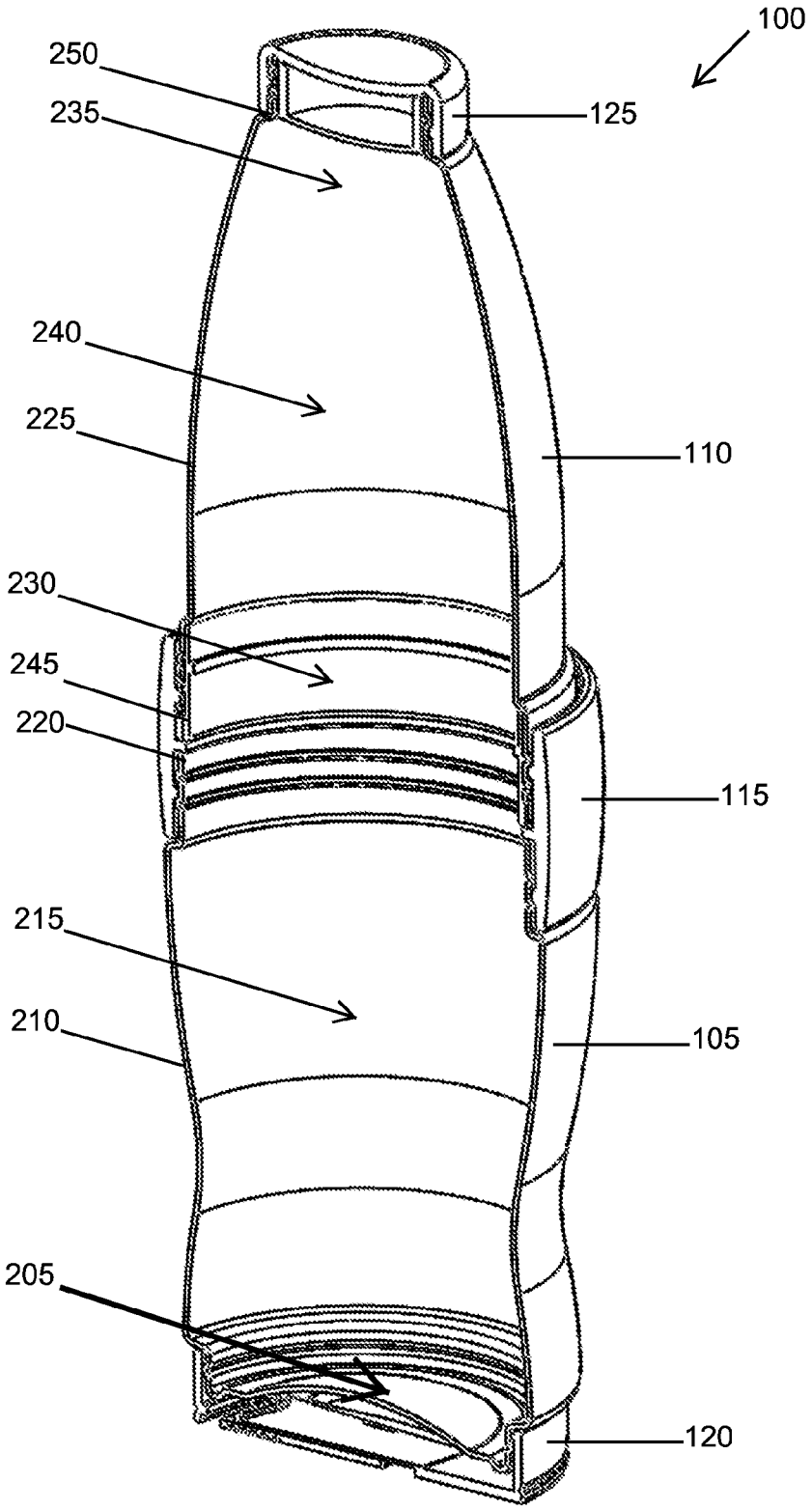
FIG. 2 illustrates a sectional view of the multimodal container shown in FIG. 1.
Figure 3:
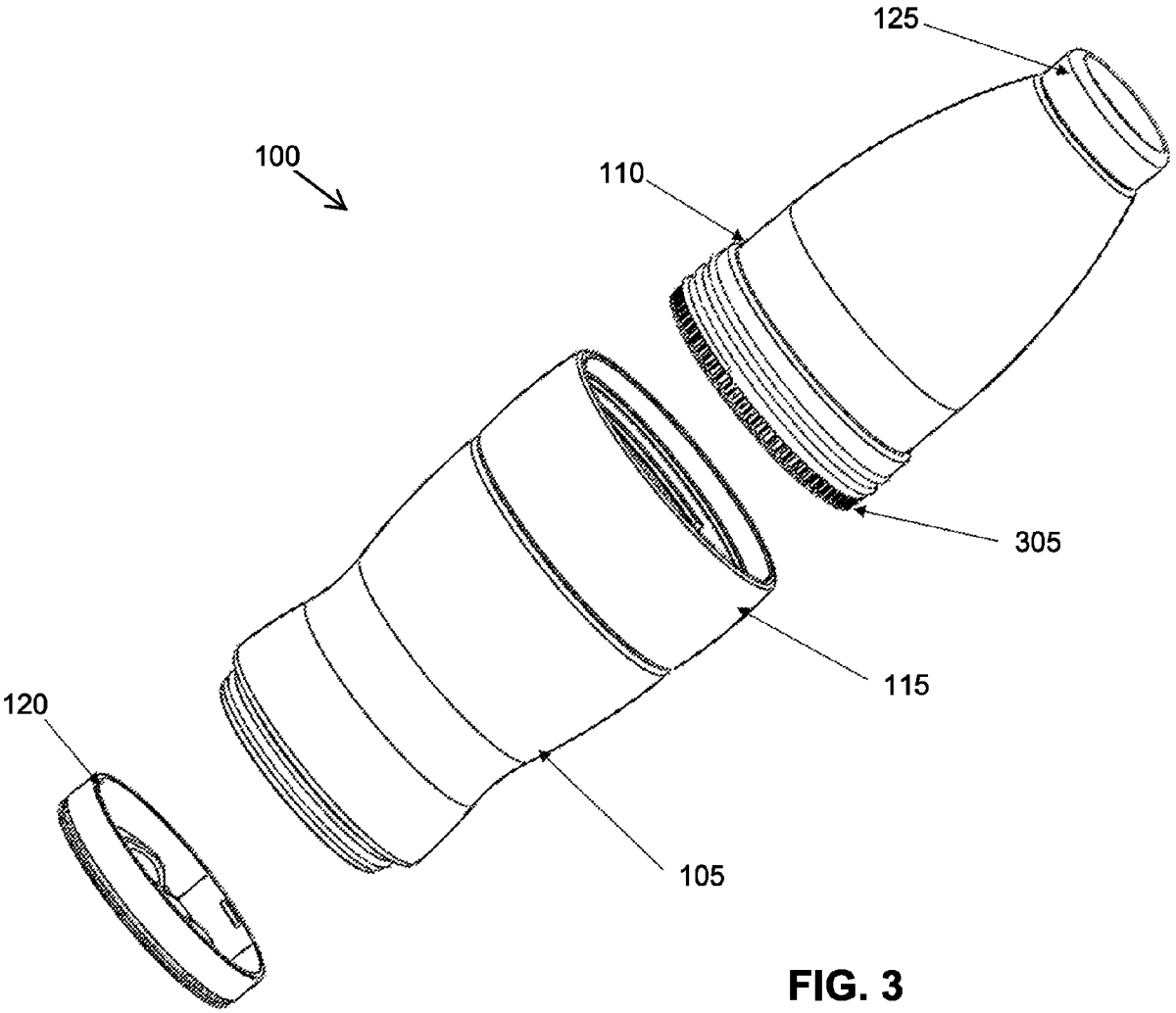
FIG. 3 illustrates an exploded view of the multimodal container shown in FIG. 1.

FIG. 1 illustrates a multimodal container 100. in a bottle configuration; FIG. 2 illustrates a sectional view of multimodal container 100 shown in FIG. 1; and FIG. 3 illustrates an exploded view of multimodal container 100 shown in FIG. 1. Multimodal container 100 includes an outer shell 105, an inner shell 110, a coupler 115, a lid 120, and a cap 125 for selectively and alternatively configuring into a bottle mode (shown in FIG. 1-FIG. 3) or a cup mode (shown in FIG. 4-FIG. 6). FIG. 3 illustrates a knurled portion 305 disposed on inner shell 110 to help make it easier to separate inner shell 110 from outer shell 105 when configured into the cup mode.

Outer shell 105 is a generally cylindrical container having a circular base 205 and an attached sidewall 210 extending away from base 205 to define a cavity 215. An opening 220 opposite of base 205 allows access to cavity 215, with opening 220 preferably being circular. A longitudinal axis 130 of outer shell 105 is aligned with a longitudinal axis 135 of inner shell 110.

Inner shell 110 is a generally cylindrical container having a generally tapering sidewall 225 extending from a wide end 230 to a narrow end 235 that defines a cavity 240. A pair of opposing openings (a wide opening 245 at wide end 230 and a narrow opening 250 at narrow end 235) allow access to cavity 240. Preferably wide opening 245 and narrow opening 250 are both circular.

Outer shell 105 and inner shell 110 are the principal elements of multimodal container 100 defining the particular mode when assembled together. In the bottle mode, opening 220 and wide opening 245 are positioned together with inner shell 110 extending away from outer 105. In the cup mode, opening 220 and wide opening 245 are positioned together with inner shell 110 extending into cavity 215. In bottle mode, the volume of multimodal container 100 is approximately equal to the sum of the volumes of cavity 215 and cavity 240. In cup mode, preferably the volume of multimodal container 100 is approximately equal to the volume of cavity 240.

In the preferred embodiments, outer shell 105 and inner shell 110 may be made from any sufficiently rigid, strong, and durable material. In many applications as noted herein, it is desirable that multimodal container 100 also be light-weight. Thus preferred materials for outer shell 105 and inner shell 110 are metals and include aluminum, stainless steel, titanium, and the like.

Coupler 115 is a preferred attachment mechanism to join inner shell 110 to outer shell 105 for the bottle and cup modes. In the preferred embodiment, opening 220 includes a first external thread portion, wide opening 245 includes a second external thread portion, and coupler 115 includes two internal thread portions complementary to the external threaded portions to mate and join inner shell 110 to outer shell 105. Coupler 115 made be made from wide variety of materials and is preferably made of a plastic or metal.

Figure 7:
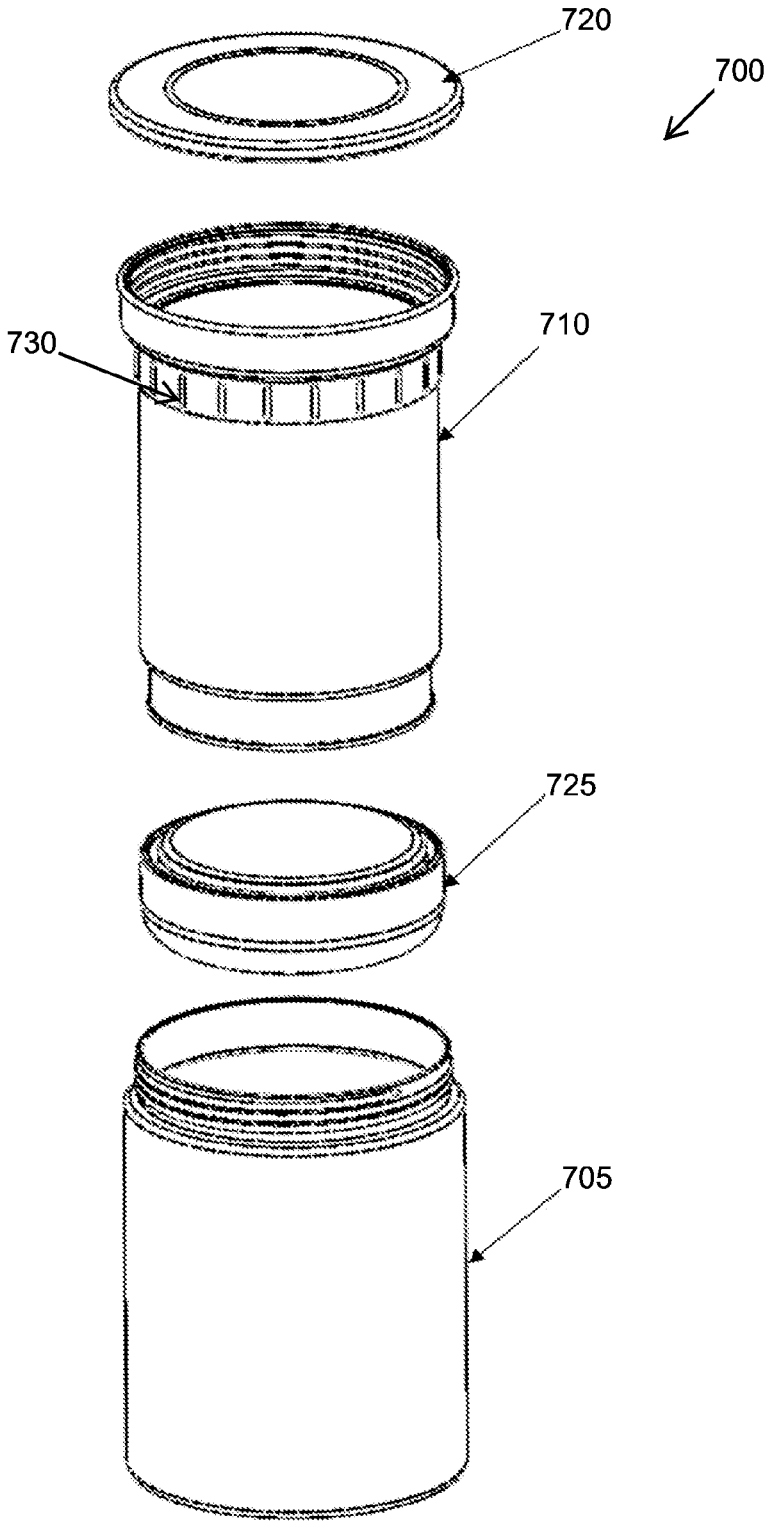
FIG. 7 illustrates an alternate simplified multimodal container.

In the preferred embodiment, coupler 115 joins inner shell 110 to outer shell 105 using a screw-type connection system. Other embodiments employ alternative attachment systems, including bayonet fast-attach systems, or other system that permits repeatable couplings and decouplings while preserving fluid-tight seals between outer shell 105 and inner shell 110 (particularly in the bottle mode). As shown in FIG. 7, some embodiments may dispense with coupler 115 as a separate discrete element. Coupling/attachment systems may be incorporated directly into outer shell 105 and inner shell 110 to permit them to be appropriately joined.

In the preferred embodiment, opening 220 has a circumference that is larger than a circumference of wide opening 245 to better enable inner shell to nest within outer shell 105 in the cup mode. Coupler 115 compensates for the different diameters of outer shell 105 and inner shell 110. In both bottle mode and cup mode, coupler 115 is threaded and tightened onto both outer shell 105 and inner shell 110 to produce a fluid-tight seal that allows the joined shells to interoperate as a bottle in bottle mode and a double-walled cup in cup mode.

Lid 120 is optional and is used during cup mode to attach to wide opening 245 to close off the double-walled cup. In bottle mode lid 120 is stored by attaching it to base 205 (snap or screw connector or the like).

Cap 125 is sized to selectively and repeatedly cover and seal narrow opening 250. In bottle mode, cap 125 permits a user to open multimodal container 100 and access the bottle contents stored in cavity 215 and cavity 240. Cap 125 also permits the user to close and seal multimodal container 100 to store and contain the bottle contents. In cup mode, cap 125 seals cavity 240 from cavity 215 and helps to ensure that cup contents stored in cavity 240 do not empty out into cavity 215.

Figure 4:
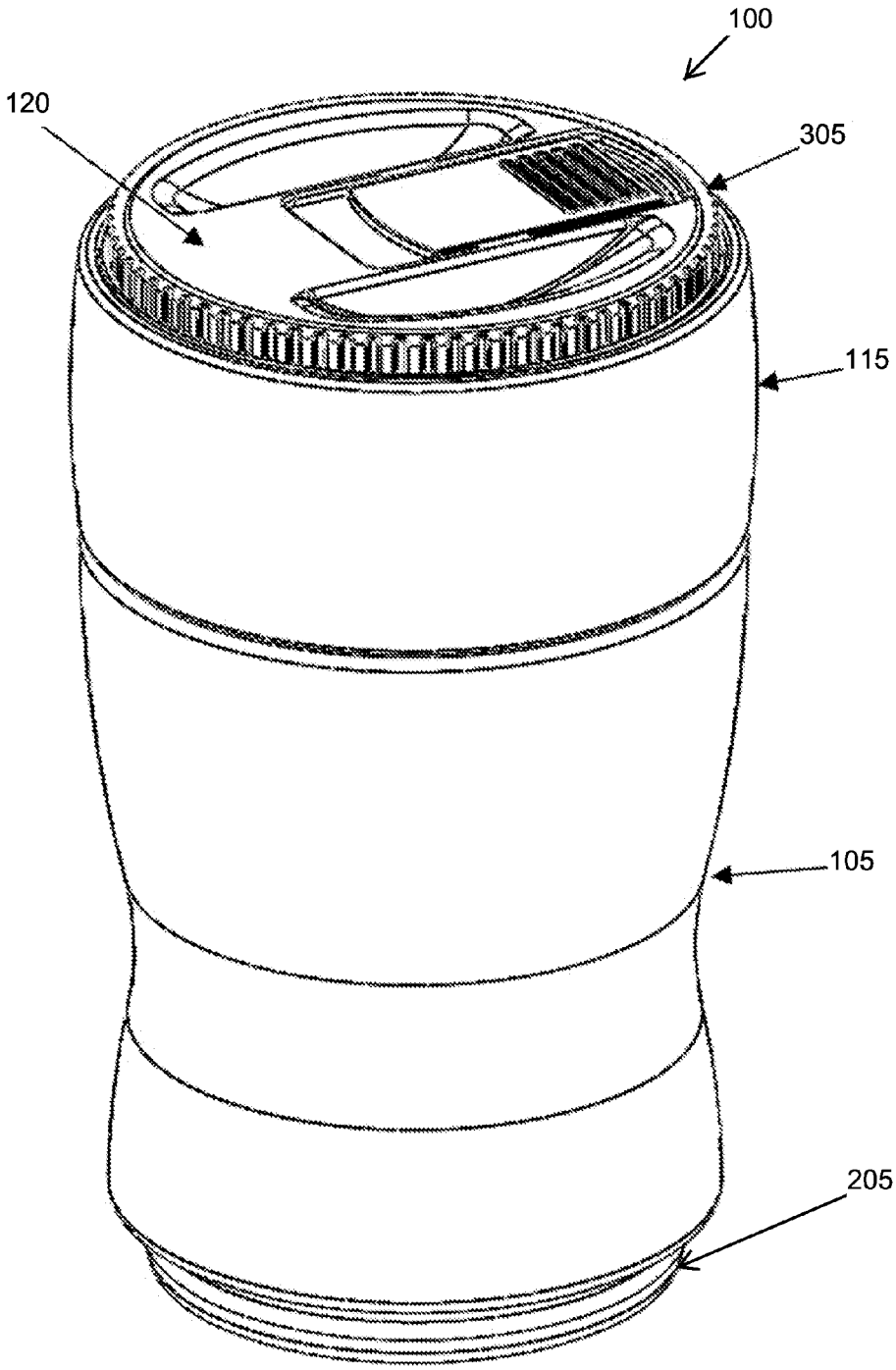
FIG. 4 illustrates the multimodal container in a cup configuration.
Figure 5:
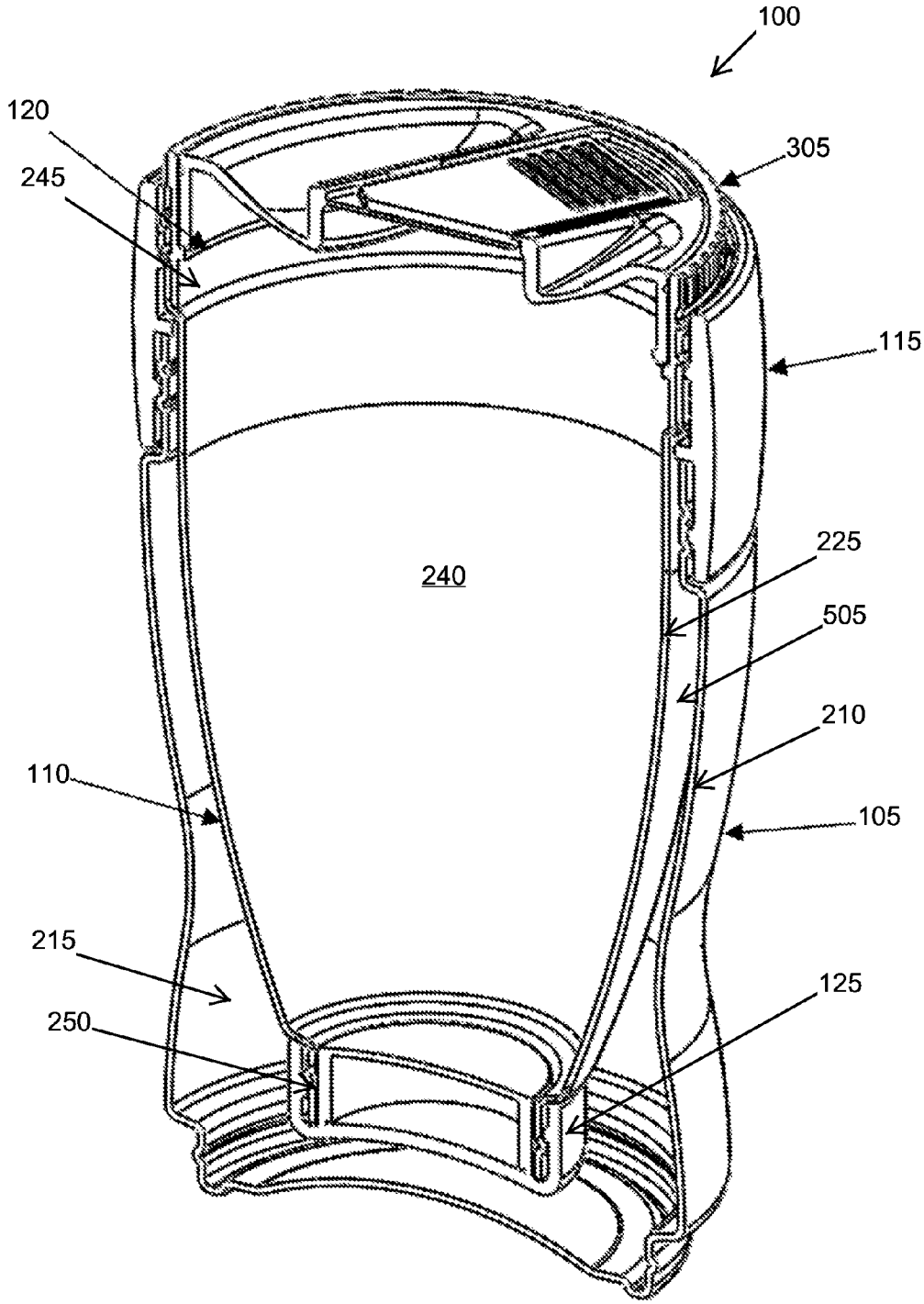
FIG. 5 illustrates a sectional view of the multimodal container shown in FIG. 4.
Figure 6:
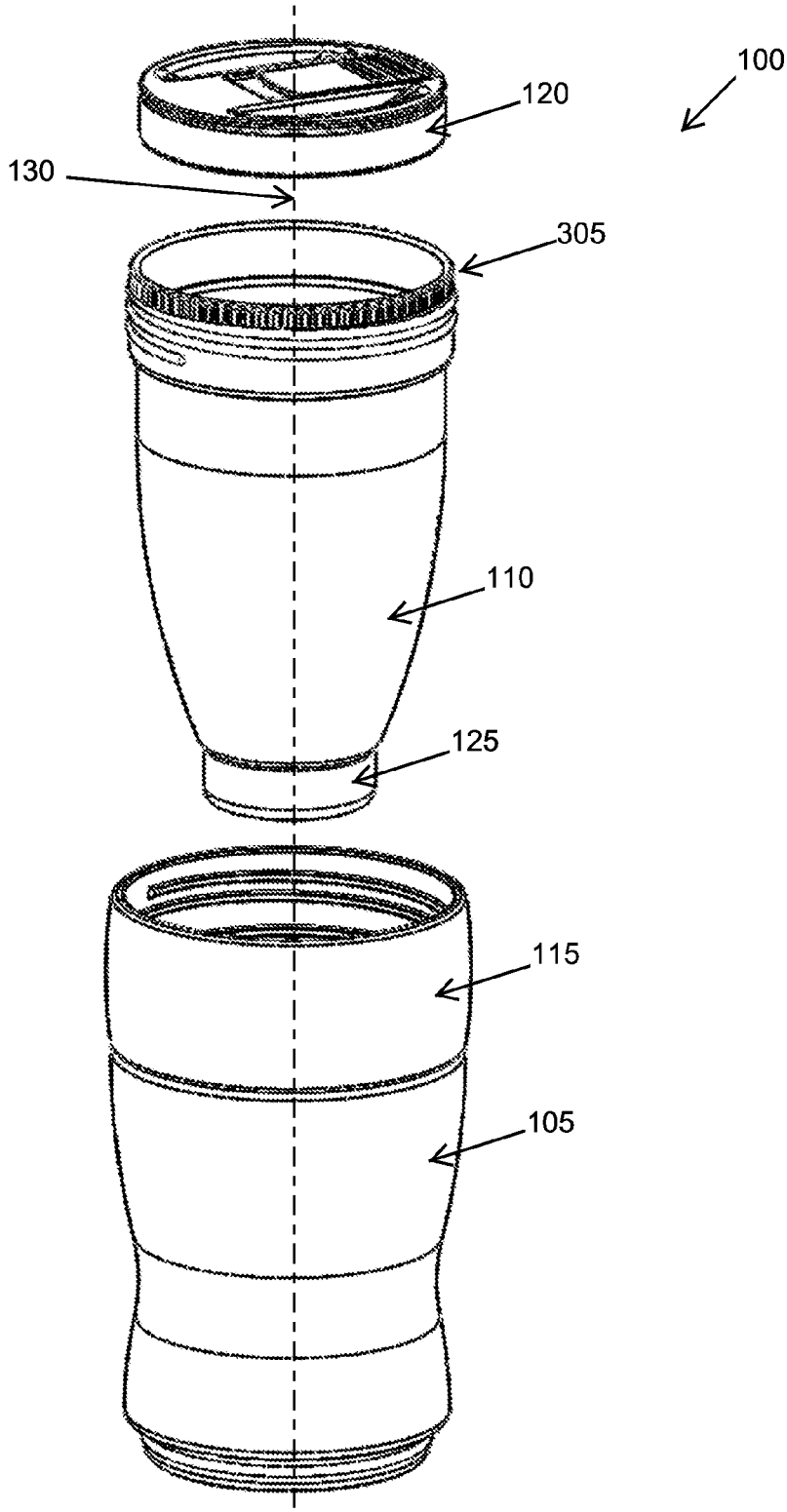
FIG. 6 illustrates an exploded view of the multimodal container shown in FIG. 4.

FIG. 4 illustrates multimodal container 100 in the cup mode; FIG. 5 illustrates a sectional view of multimodal container 100 shown in FIG. 4; and FIG. 6 illustrates an exploded view of multimodal container 100 shown in FIG. 4. Multimodal container 100 in cup mode shown in FIG. 4-FIG. 6 includes the elements shown in FIG. 1-FIG. 3 arranged in different fashion.

Inner shell 110 is disposed within cavity 215 of outer shell 105 with cap 125 installed on narrow opening 250 to define an insulating gap 505 between sidewall 210 of outer shell 105 and sidewall 225 of inner shell 110. Multimodal container 100 in the cup mode thus is a double-wall construction providing the user with a volume about equal to volume of cavity 240. Gap 505 thus helps to maintain a temperature of hot/cold cup contents as well as helping to insulate fingers/hand of a user holding multimodal container 100 in cup mode with hot/cold contents.

In a preferred embodiment, lid 120 is a "sipper" or other controlled release cover for multimodal container 100 in the cup mode. Lid 120 engages wide opening 245 and helps to insulate contents of cavity 240 as well as limit spills and inadvertent discharges of cup contents, particularly when the contents may be hot. A sliding or rotatable closure mechanism may be incorporated into lid 120 to seal multimodal container 100 while not drinking.

As seen in FIG. 5, knurled portion 305 is exposed and accessible to the user in the cup mode. Knurled portion 305 disposed on an exterior perimeter edge of wide opening 245 thus enables the user to grip and uncouple inner shell 110 from outer shell 105 when multimodal container 100 is in the cup mode.

FIG. 7 illustrates an alternate simplified multimodal container 700. Multimodal container 700 includes an outer shell 705, an inner shell 710, a lid 720, and a cap 725 for selectively and alternatively configuring into a bottle mode (similar to that shown in FIG. 1-FIG. 3) or a cup mode (similar to that shown in FIG. 4-FIG. 6). Multimodal container 700 provides for an external thread portion 730 near an opening 735 of outer shell 705 and an internal thread portion 740 near a wide opening 745 of inner shell 710. The two thread portions selectively engage each other to provide the bottle mode of multimodal container 700. Multimodal container 700 includes a retaining mechanism, depicted in FIG. 7 by a series of elastomeric/polymeric structures 750 distributed on an outside of inner shell 710. The cup mode is provided by sizing series of elastomeric/polymeric structures 750 to be a "press fit" frictional retaining system to engage an inside of outer shell 705 and hold it against unintended separation. In some embodiments it may be desirable to provide an airtight seal, in which case series of elastomeric/polymeric structures 750 may be molded/formed into an "O" ring or the like. Other systems are possible to engage/retain inner shell 710 within outer shell 705 than these disclosed herein. Since it is the case that cap 725 engages inner shell 710 while it is disposed within outer shell 705, series of elastomeric/polymeric structures 750 are not required to be fluid tight to inhibit leakage of cup-mode multimodal container 700 contents out between outer shell 705 and inner shell 710.

In cup mode, multimodal container 100 takes up about half as much space as bottle mode, thus allowing it to stow compactly with other gear. When empty, multimodal container 100 serves as additional storage space for water filters or water treatment devices, or food or beverage mixes.

Separately, inner shell 110 with cap 125 removed, is usable as a funnel to direct fluid from one container to another. Alternately, such as in a survival situation, filtering material such as cloth or leaves or sand can be placed in the inner shell 110 to be used as a primitive water filtering system. Separately, outer shell 105 is useable as an additional noninsulated drinking cup or, with lid 120 removed, a cooking pot.

In some cases, it may be desirable/beneficial/necessary to provide more of an insulating function for the insulating air gap between the outer shell and the inner shell when the multimodal container is in the cup mode. By providing an airtight seal at the opening of the outer shell with respect to the inner shell, and providing a valve (e.g., a one-way valve or the like) to selectively draw out the air from the gap between the shells (e.g., using a pump or the like), it is possible to create an improved insulating function. There are many ways of implementing such a mechanism.

The system and methods above has been described in general terms as an aid to understanding details of preferred embodiments of the present invention. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A multimodal container selectively, alternatively, and repeatably reconfigurable between a cup mode and a bottle mode, comprising:

an outer shell having a closed base, a top, and a first wall coupled to said base and extending to said top, said first wall defining a first cavity having a first volume and a first cavity opening into said first volume generally opposite of said base at said top, a portion of a first periphery of said first wall at said top including a first closure structure;

an inner shell having first end, a second end, and a second wall extending from said first end to said second end defining a second cavity having a second volume and a second cavity opening at said first end, a portion of a second periphery of said second wall at said first end including a second closure structure; and a coupler engaging and sealing both said shells proximate said first cavity opening and said second cavity opening in both the cup mode and the bottle mode, said coupler including a first portion having a third closure structure complementary to said first closure structure and including a second portion having a fourth closure structure complementary to said second closure structure;

wherein the cup mode includes said first cavity opening proximate said second cavity opening with said inner shell nested within said outer shell and said second end extending towards said base; and wherein the bottle mode includes said first cavity opening proximate said second cavity opening with said second end extending away from said base.

2. The multimodal container of claim 1 wherein said first closure structure is disposed on an exterior portion of said first sidewall, said second closure structure is disposed on an exterior portion of said second sidewall, and said third closure structure and said fourth closure structure both disposed on an interior portion of said coupler.

3. The multimodal container of claim 1, further comprising:

a cap resealably closing said second end and wherein the cup mode provides a contents volume equal to said second volume and wherein the bottle mode provides said contents volume equal to both said first volume and said second volume.

4. The multimodal container of claim 1 wherein said closed base includes a base perimeter defining a fifth closure structure, further comprising:

a lid including a sixth closure structure complementary to said fifth structure configured to engage said fifth closure structure of said closed base in the bottle mode and configured to close said second cavity opening in the cup mode.

* * * * *